US009808045B2

(12) United States Patent
Carlson et al.

(10) Patent No.: US 9,808,045 B2
(45) Date of Patent: Nov. 7, 2017

(54) FOOTWEAR HAVING AN ADJUSTABLE WIDTH FEATURE

(71) Applicant: Mizuno USA, Inc., Norcross, GA (US)

(72) Inventors: Jess Paul Carlson, Cleveland, OH (US); David Michael Pehar, Cleveland, OH (US); Jeffrey Silver Taggart, Cleveland, OH (US); Andrew Douglas Smith, Cleveland Heights, OH (US)

(73) Assignee: MIZUNO USA, INC., Norcross, GA (US)

( * ) Notice: Subject to any disclaimer, the term of this patent is extended or adjusted under 35 U.S.C. 154(b) by 0 days.

(21) Appl. No.: 14/986,210

(22) Filed: Dec. 31, 2015

(65) Prior Publication Data

US 2017/0188655 A1 Jul. 6, 2017

(51) Int. Cl.

| | |
|---|---|
| ***A43B 13/14*** | (2006.01) |
| ***A43B 3/26*** | (2006.01) |
| ***A43B 13/18*** | (2006.01) |
| ***A43B 3/02*** | (2006.01) |
| ***A63C 17/00*** | (2006.01) |
| ***A43B 5/00*** | (2006.01) |

(52) U.S. Cl.

CPC ..... *A43B 3/26* (2013.01); *A43B 3/02* (2013.01); *A43B 5/00* (2013.01); *A43B 13/141* (2013.01); *A43B 13/181* (2013.01); *A63C 17/00* (2013.01)

(58) Field of Classification Search

CPC ..... A43B 3/26; A43B 13/141; A43B 5/1608
USPC ..... 36/97
See application file for complete search history.

(56) References Cited

U.S. PATENT DOCUMENTS

| | | | | |
|---|---|---|---|---|
| 4,166,329 | A * | 9/1979 | Herbig | A43B 7/1465 36/91 |
| 5,729,912 | A * | 3/1998 | Gutkowski | A43B 3/26 36/93 |
| 6,138,385 | A * | 10/2000 | Jungkind | A43B 1/0018 36/102 |
| 6,497,420 | B2 * | 12/2002 | Ricci | A43B 1/0072 280/11.16 |
| 2006/0162191 | A1 * | 7/2006 | Mason | A43B 3/26 36/97 |
| 2010/0139122 | A1 | 6/2010 | Zanatta | |

(Continued)

OTHER PUBLICATIONS

International Search Report and Written Opinion of the International Searching Authority for related International Patent Application No. PCT/US2016/069100 dated Mar. 27, 2017.

*Primary Examiner* — Ted Kavanaugh
(74) *Attorney, Agent, or Firm* — Troutman Sanders LLP; James E. Schutz; Daniel T. Sharpe

(57) ABSTRACT

An article of footwear having an adjustable width is disclosed. The article of footwear can include a lower sole and an upper sole. The lower and upper soles can have grooves to allow for expansion and contraction. The article of footwear can also include a width adjustment assembly. The width adjustment assembly can have a lead screw, an adjustment device accessible to a wearer from the outside of the article of footwear, an actuation strap, an anchor plate connected to the actuation strap. Rotation of the adjustment device can cause the lead screw to rotate, which in turn can change the tension in the actuation strap. Changes to the tension in the actuation strap can cause the width of the forefoot portion of an article of footwear to be adjusted.

19 Claims, 11 Drawing Sheets

(56) References Cited

U.S. PATENT DOCUMENTS

| | | | | |
|---|---|---|---|---|
| 2011/0047826 | A1 | 3/2011 | Rosen | |
| 2011/0146105 | A1* | 6/2011 | Caeran | A43B 3/26 36/97 |
| 2013/0152426 | A1* | 6/2013 | Lederer | A43B 3/26 36/97 |

* cited by examiner

FOOTWEAR HAVING AN ADJUSTABLE WIDTH FEATURE

BACKGROUND OF THE INVENTION

1. Field of the Invention

The present invention relates generally to articles of footwear having an adjustable width, and more particularly to articles of footwear capable of allowing a wearer to alter the width of the forefoot portion thereof.

2. Background of Related Art

The fit of articles of footwear, such as athletic shoes, is often critical to the wearer's performance and/or comfort. Most footwear is sold in a discrete number of sizes, with each size having a characteristic length and width. Such a system typically provides enough variety for most people to find a size that fits well enough to wear without significant discomfort, however, because the lengths and widths are inextricably linked by the discrete sizes, some people find their closest fit size is either too wide or too narrow for their foot.

Additionally, a number of factors may cause a wearer to desire a wider or narrower fit at different times. For example, a person's foot is known to change size in response to a number of factors such as the time of day, the temperature, or a medical condition. Even aside from actual changes in a person's foot size, other factors may influence the desired fit such as the type of sock worn, braces or wraps on the foot or ankle, and/or personal preference for different fits in different situations. For instance, some athletes prefer a tighter fit during a game, competition, or race than they desire for non-competition activities like warm-ups. All these reasons and more evidence a need to provide an article of footwear that allows a wearer to adjust the width to suit their needs.

Past attempts to address this need have been met with limited success. Mechanisms such as pumps, interchangeable insoles, or lacing/strapping systems have been employed in the past to provide some level of adjustability. These mechanisms each have shortcomings. Some of these shortcomings can be in one or more of: durability, ease of adjustment, comfort, and range of adjustment. In the case of an athletic shoe, shortcomings in one or more of these areas may result in the wearer suffering a loss of performance, reduced comfort, or a shortened lifespan of the shoe.

What is needed, therefore, is an article of footwear that allows the wearer to adjust a dimension of the shoe, such as the width, in an improved manner. The article should provide for simple and reliable adjustment, while preserving the comfort and durability of the article. It is to such an article of footwear that embodiments of the present invention are primarily directed.

BRIEF SUMMARY OF THE INVENTION

Embodiments of the present disclosure relate to an article of footwear having an adjustable width. In some embodiments, the article of footwear can include a sole and a width adjustment assembly. To provide for width adjustment, the sole may include grooves in an upper and lower portion thereof. Rather than attempting to compress the sole material, the grooves can allow for the necessary movement.

A width adjustment assembly in accordance with the present disclosure can include a lead screw connected to an adjustment device. The adjustment device may be accessible to a wearer from the outside of the article of footwear by protruding from the sole. A width adjustment assembly can also include an actuation strap connected to the lead screw such that rotation of the lead screw causes a corresponding motion of the actuation strap. The actuation strap can be connected to an anchor plate connected to the sole.

In some embodiments, the sole can have an upper sole and a lower sole, with the width adjustment assembly located between the two. The width adjustment assembly may be generally located at about the forefoot portion of the sole, and components of the assembly may reside in an adjustment device housing. The adjustment device can be an adjustment paddle, and can have a stowed position in which the paddle is in the adjustment device housing and a deployed position in which it protrudes from the housing. In the stowed position, the adjustment paddle may be incapable of rotating, whereas in the deployed position it may be rotatable by a wearer.

The anchor plate can be positioned on the instep portion of the article, and the adjustment device can be positioned on the outstep portion of the article of footwear. When the lead screw rotates, it can cause the actuation strap to move the anchor plate towards the outstep portion of the article. In some embodiments, the actuation strap can be connected to the lead screw via a nut that is threaded onto the lead screw. As the lead screw rotates, the nut may move linearly, and pull or push the actuation strap as it does.

These and other objects, features, and advantages of the present invention will become more apparent upon reading the following specification in conjunction with the accompanying drawing figures.

BRIEF DESCRIPTION OF THE DRAWINGS

FIG. 2-1 depicts a bottom view of the sole portion of the article of footwear having an adjustable width of FIG. 1.

FIG. 1-2 depicts a perspective view of an alternative embodiment of FIG. 1-1.

FIG. 2-2 depicts a bottom view of the sole portion of the article of footwear having an adjustable width of FIG. 1-2.

FIG. 4-1 depicts a top view of a width adjustment mechanism, in accordance with an embodiment of the present disclosure.

FIG. 4-2 depicts a top view of an alternative embodiment of FIG. 4-1.

FIG. 7A-1 depicts a cross-sectional view of the article of footwear of FIG. 1-1 in its widest position, taken along line 7-7.

FIG. 7B-1 depicts a cross-sectional view of the article of footwear of FIG. 1-1 in a narrower position than that of FIG. 7A-1, taken along line 7-7.

FIG. 7A-2 depicts a cross-sectional view of the article of footwear of FIG. 1-2 in its widest position, taken along line 7-7.

FIG. 7B-2 depicts a cross-sectional view of the article of footwear of FIG. 1-2 in a narrower position than that of FIG. 7A-2, taken along line 7-7.

DETAILED DESCRIPTION OF THE INVENTION

Figures 1, 2:
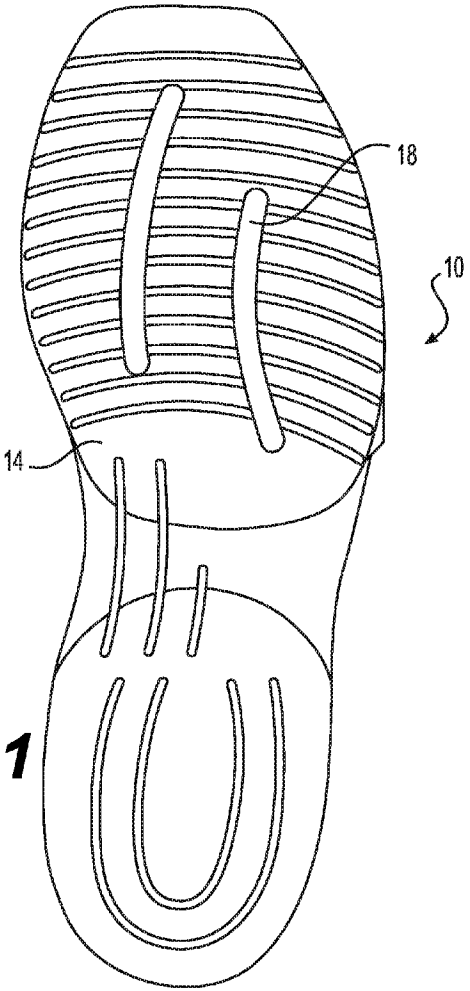
Figure 1:
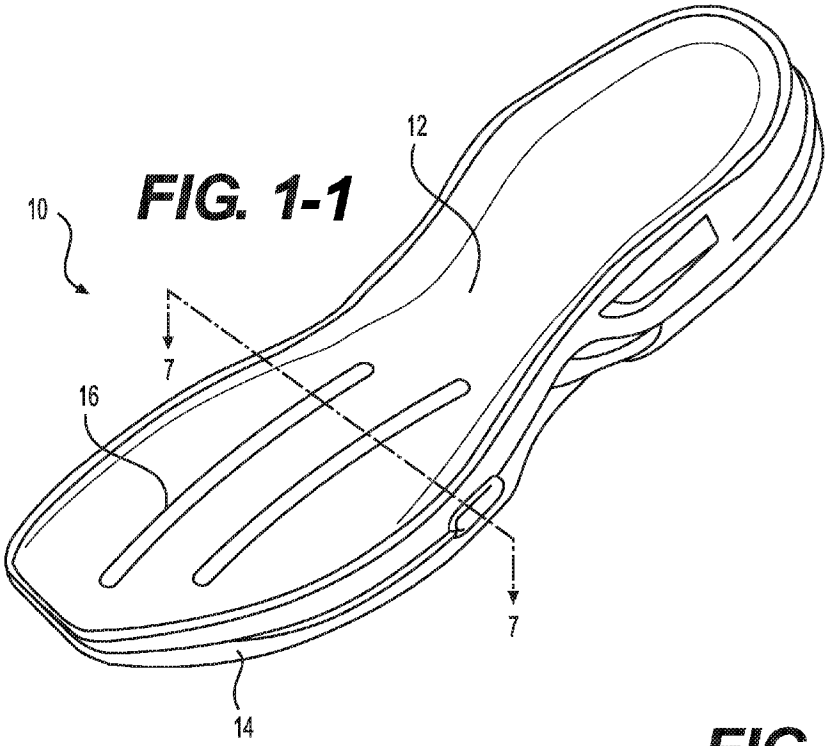
FIG. 1-1 depicts a perspective view of the upper and lower sole portions of an article of footwear having an adjustable width, in accordance with some embodiments of the present disclosure.
Figure 2:
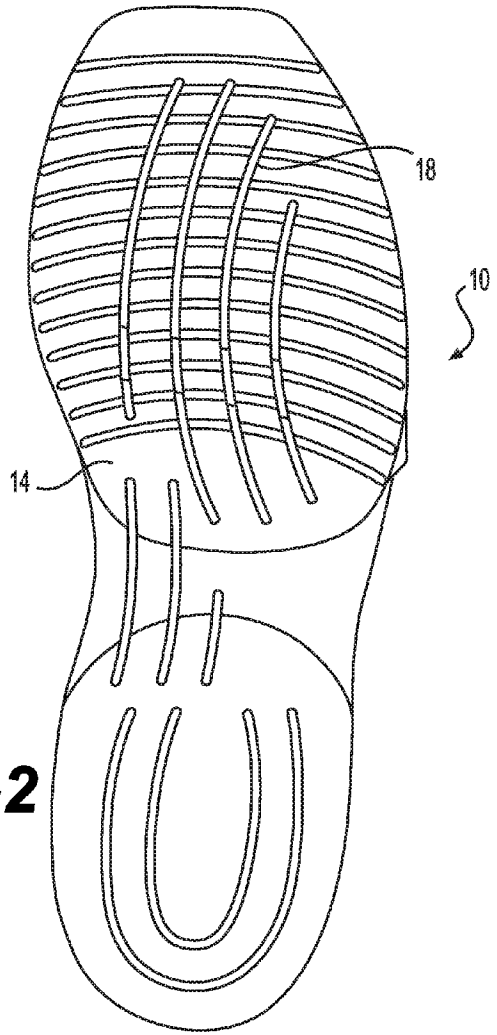
Figures 1, 2:
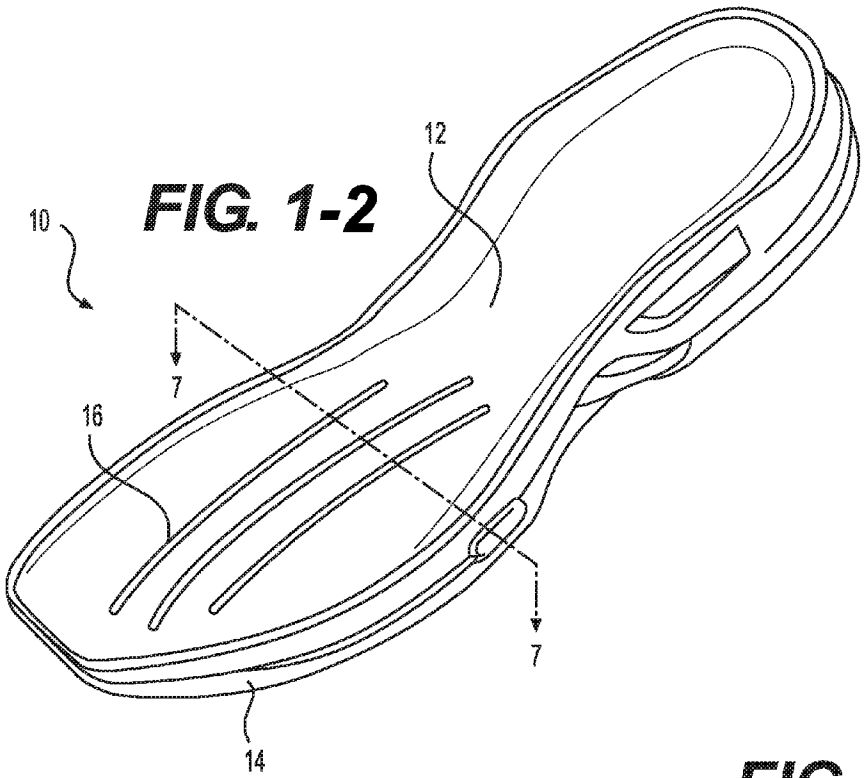

Embodiments of the present invention relate generally to articles of footwear, and more particularly to articles of footwear including an adjustable width mechanism. In some embodiments, the width of an article of footwear can be adjusted by manipulating an adjustment device located on the outsole of the article. The adjustment device may be a part of a width adjustment assembly that provides for grooves in the sole to be selectively compressed. In some embodiments, a user rotates an adjustment device, and a lead screw causes an anchor at the opposite side of the article to be pulled towards the adjustment device. This may result in a change in the width of the article.

To simplify and clarify explanation, the invention is described herein as an athletic shoe having a width adjustment feature. One skilled in the art will recognize, however, that the invention is not so limited.

The materials described hereinafter as making up the various elements of the present invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention.

As described above, a general problem with conventional footwear is that it is sold in a discrete number of sizes, with each size having a characteristic length and width. While this is economical for manufacturers and retailers, it often means that consumers do not get an optimal fit. A poorly fitting article of footwear can have a number of adverse effects ranging from mild discomfort to serious injury. The present disclosure relates to solutions to the problem of footwear fit in the form of an article of footwear that is durable, easy to adjust, and comfortable.

Embodiments of the present disclosure can comprise an article of footwear having an adjustable width feature. More specifically, embodiments of the present disclosure can comprise an athletic shoe that enables a wearer to adjust the width of the forefoot portion of an athletic shoe to achieve a desired fit. The adjustable shoe can also comprise mechanisms for providing varying degrees of adjustment depending on, for example, the activity for which the shoe is intended.

In order to simplify and clarify the explanation, FIGS. 1-7 depict the lower portion of an article of footwear. A width adjustment mechanism as herein described can be included in any number of different shoes, boots, skates, or other footwear. Those articles may vary in the upper portion of the article, but will generally share a somewhat similar sole design, in that they will include a generally flat surface designed to be in contact with the foot of a wearer. Upper portions of an article of footwear are not depicted, as they are well known in the art, but a sole according to the present disclosure is capable and designed to include an upper portion as in a typical shoe, boot, skate, or other known article of footwear.

In some embodiments, as shown in FIGS. 1-1, 2-1, 1-2, and 2-2, a sole assembly 10 for an article of footwear may comprise an upper sole 12 and a lower sole 14. In order to accommodate changes in width, upper sole 12 may be provided with grooves 16, and lower sole 14 may be provided with grooves 18. Grooves 16, 18 can enable the sole assemblies 12, 14 to expand and contract as the width of the footwear is adjusted. The shape of grooves 16, 18 may be selected in order to allow sole assembly 10 to expand and contract in the width dimension without substantially changing the overall contour of the shoe. Sole assembly 10 may be constructed using similar materials and methods as conventional footwear. In some embodiments, upper and lower soles may be co-molded as a single-piece lower portion of the article or formed as a unitary sole.

Figure 3A:
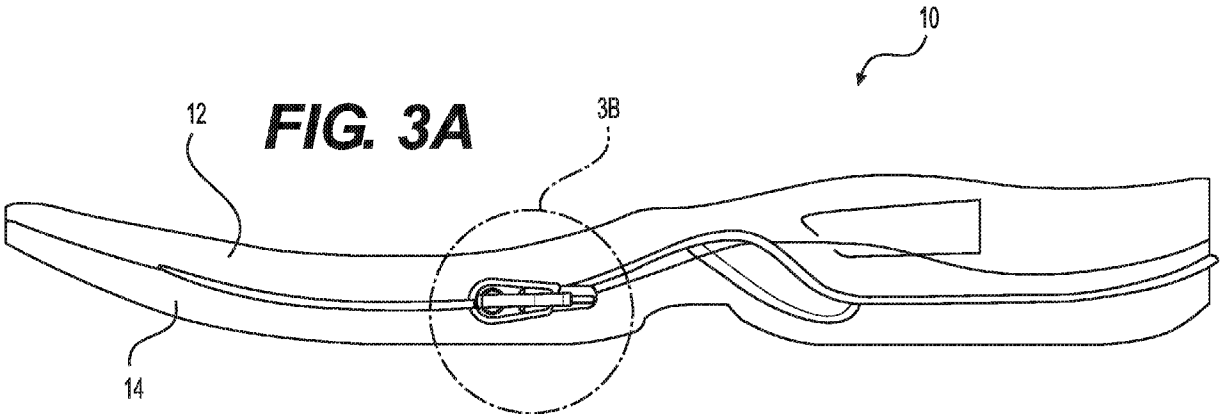
FIG. 3A depicts a side view of the outstep portion of the article of footwear having an adjustable width of FIG. 1.
Figure 3B:
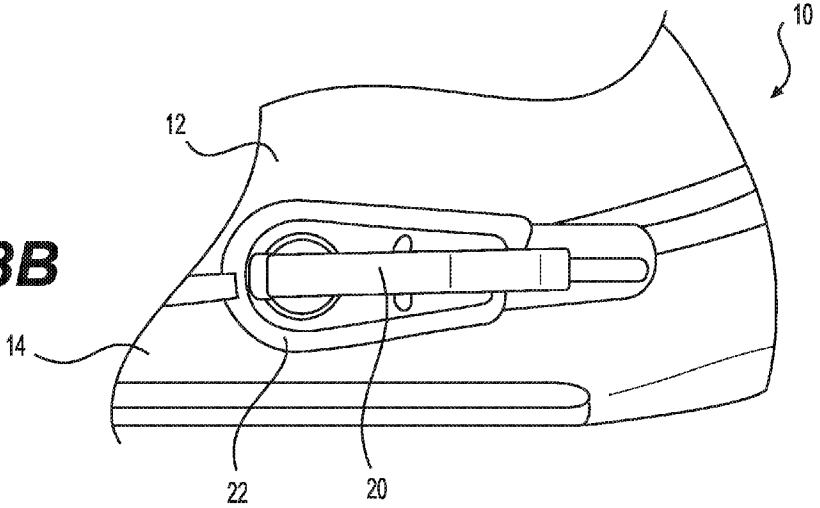
FIG. 3B depicts a close-up side view of the area in the dotted and dashed circle shown in FIG. 3A.

FIG. 3A shows a side view of sole assembly 10, and FIG. 3B shows a close up view of adjustment paddle 20 stowed inside adjustment paddle housing 22. Adjustment paddle 20 may be positioned on the outstep side of sole assembly 10, between upper sole 12, and lower sole 14.

Figures 1, 4:
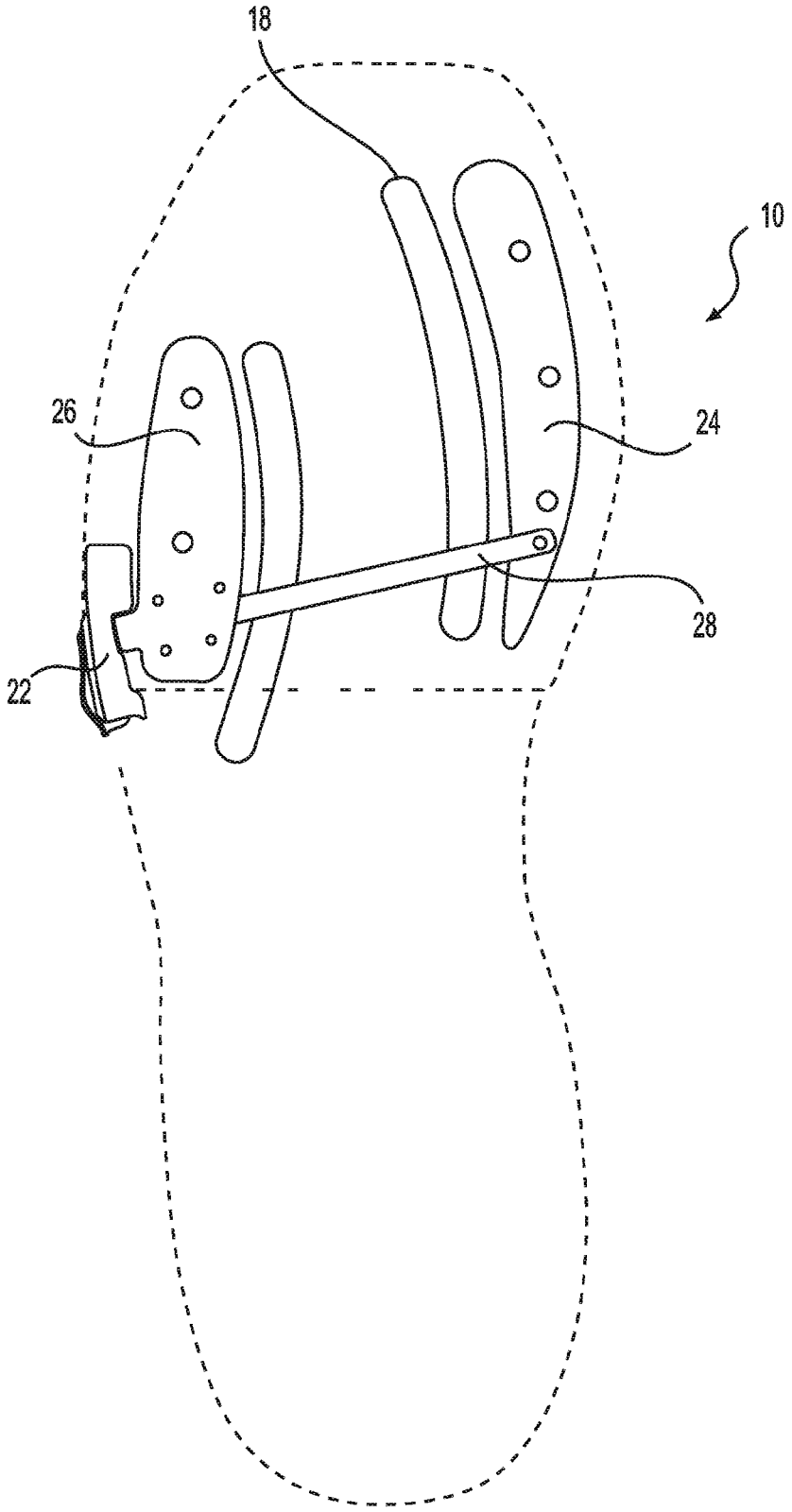
Figures 2, 4:
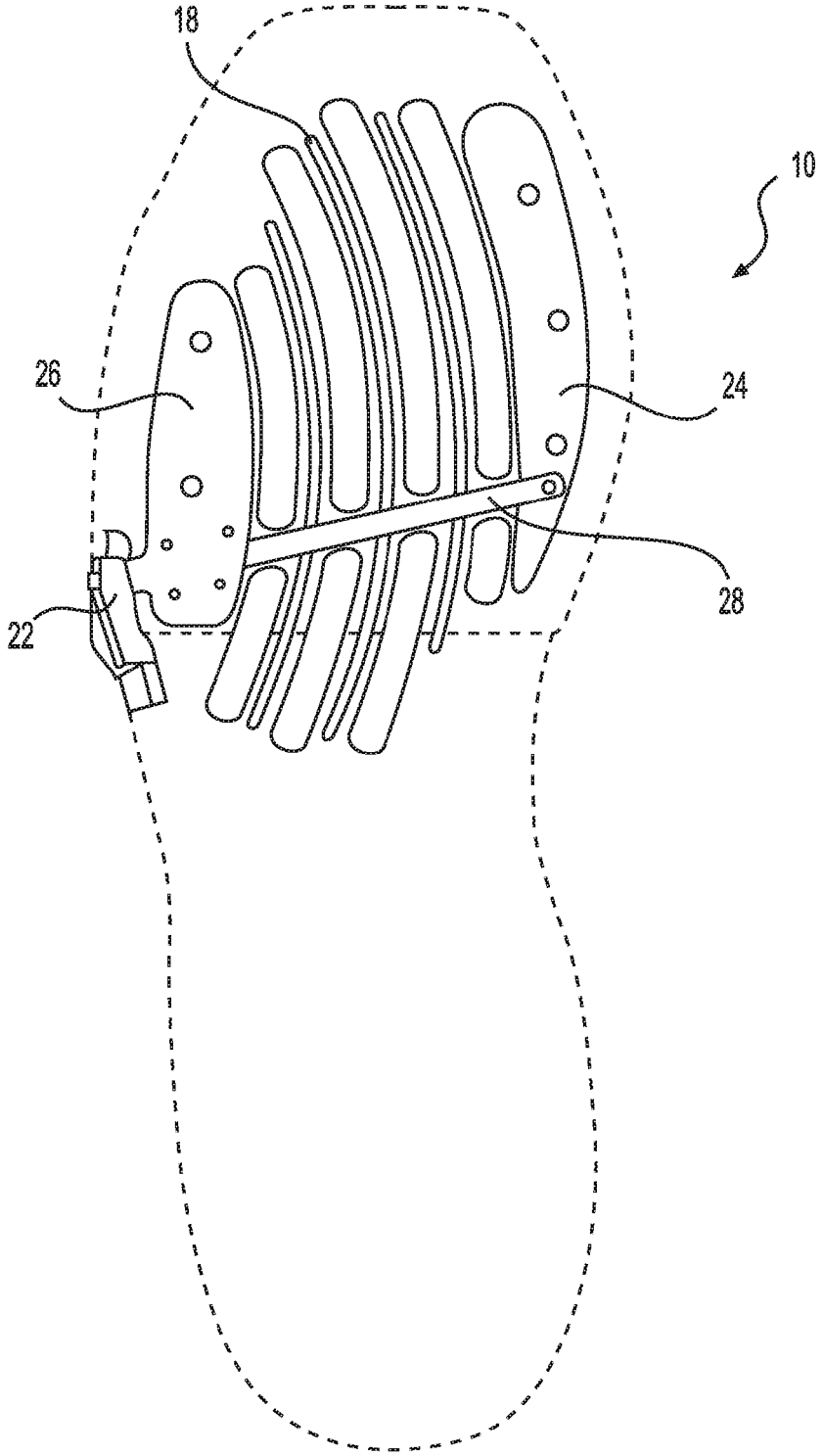
Figure 5:
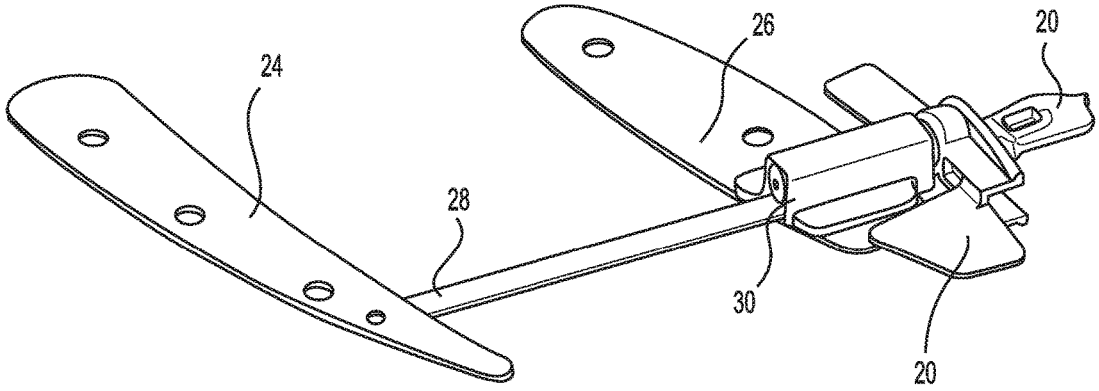
FIG. 5 depicts a bottom perspective view of the width adjustment mechanism, in accordance with an embodiment of the present disclosure.
Figure 6:
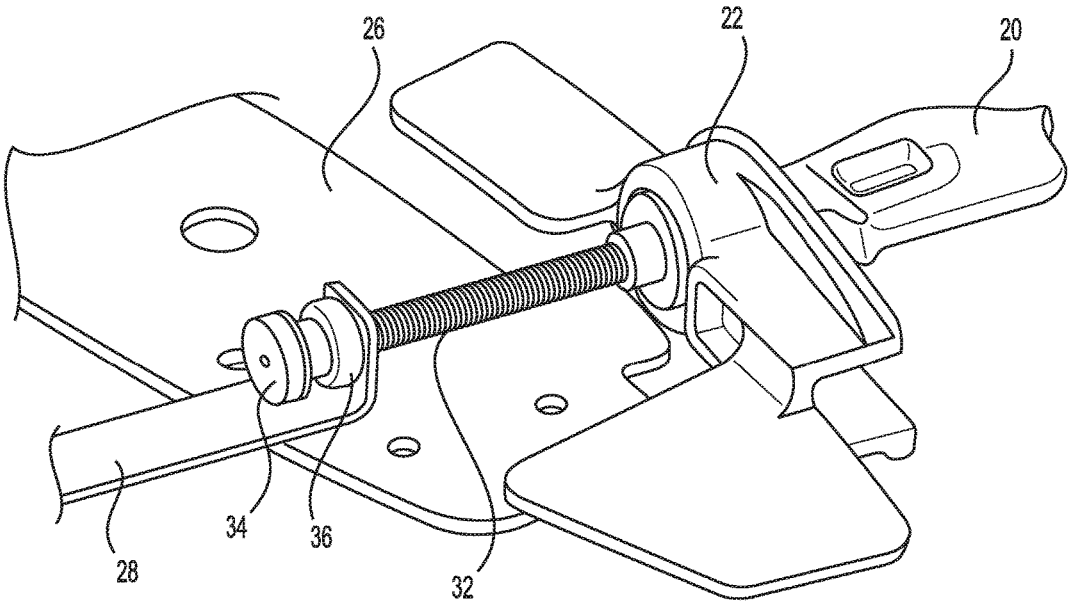
FIG. 6 depicts a perspective view of the width adjustment mechanism of FIG. 5 with the housing portion removed.

FIGS. 4-1 and 4-2 show the internal components that form the width adjustment assembly as viewed from above with the upper and lower soles removed. Anchor 24 is located in the forefoot portion of sole assembly 10, opposite adjustment device anchor 26. Actuation strap 28 is connected to anchor 24, and runs generally perpendicular to the length of sole assembly 10. FIG. 5 shows the components of FIG. 4-1 (similar to FIG. 4-2), as they appear when viewed from below the sole. From this perspective, adjustment device housing 30 is visible. In FIG. 6, adjustment device housing 30 has been removed to show the inner components of the adjustment assembly. Lead screw 32 is connected to adjustment paddle 20 on one end, and end bearing 34 on an opposite end. As lead screw 32 rotates, nut 36 traverses lead screw 32 linearly towards or away from end bearing 34. The pitch of lead screw may be selected such that it prevents forces in the length direction of actuation strap 28 from rotating or adjusting the position of nut 36. Actuation strap 28 is in communication with nut 36 such that the movement of nut 36 along lead screw 32 translates to movement or tension in the strap 28.

As nut 36 and actuation strap 28 move, anchor 24 is pulled towards adjustment device anchor 26. Since anchor 24 is integrally connected to the upper sole 12 and the lower sole 14, when anchor 24 moves towards adjustment device anchor 26, it causes grooves 16 and grooves 18 to be compressed. This compression results in the forefoot portion of sole assembly 10 to narrow. As discussed above, narrowing the forefoot portion of an article of footwear can result in improved fit and stability for the wearer. FIGS. 7A-1, 7B-1, 7A-2, and 7B-2 serve to further clarify the operation of the adjustment device.

Figures 1, 7A:
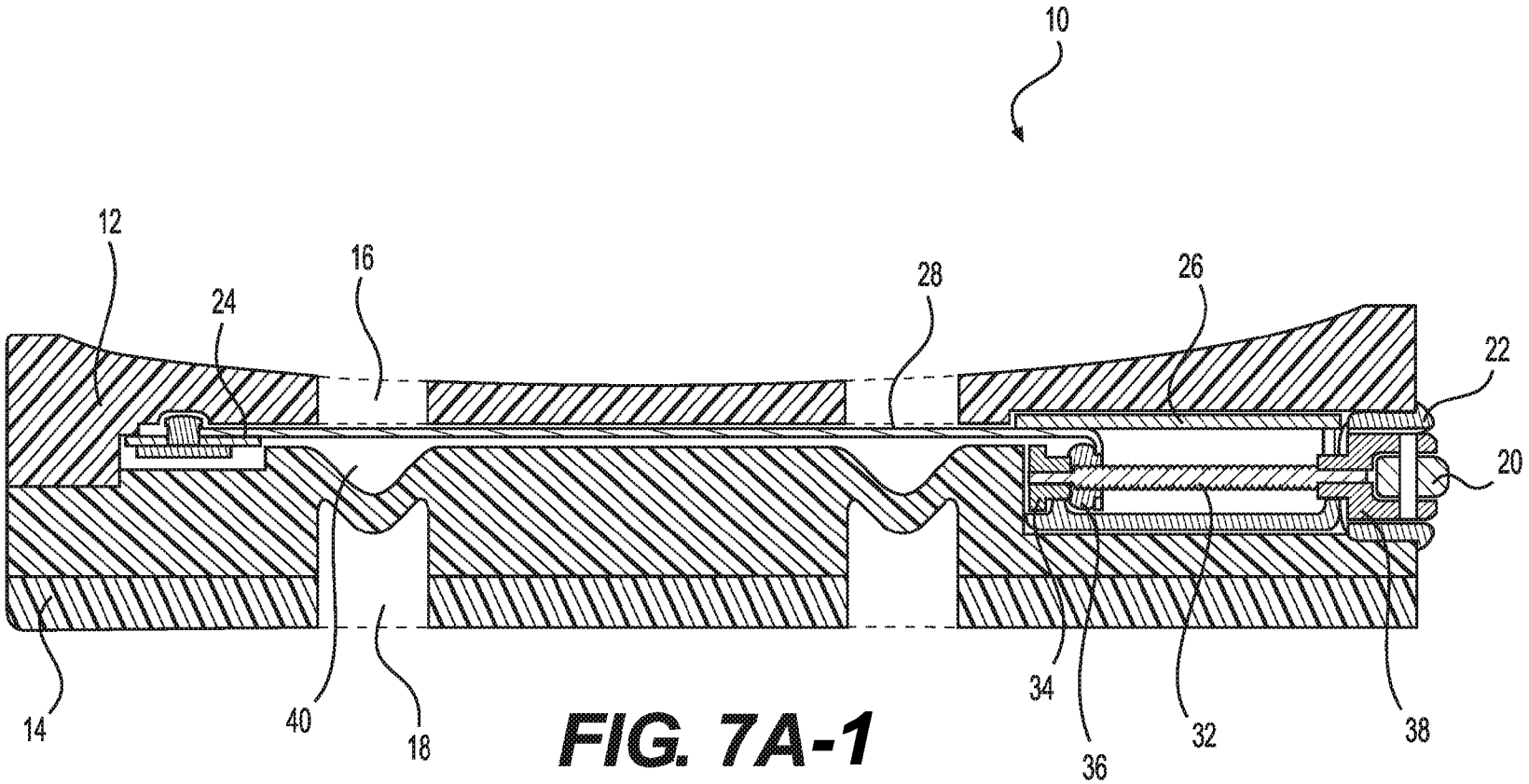

FIGS. 7A-1 and 7A-2 show a cross section of sole assembly 10 in its widest orientation. When the sole assembly is in its widest orientation, nut 36 is in a position closest to end bearing 34. The arrangement of nut 36 and end bearing 34 may prevent nut 36 from travelling too far in either direction. In this way the mechanism may be self-limiting in its adjustment range to maintain reliability and prevent jamming or breaking. The nut's location closest to end bearing 34 may release substantially all or most of the tension on actuation strap 28, and this may allow anchor 24 to be in a position furthest from adjustment device anchor 26. In this orientation, grooves 16 and grooves 18 may be substantially uncompressed.

Figures 1, 7B:
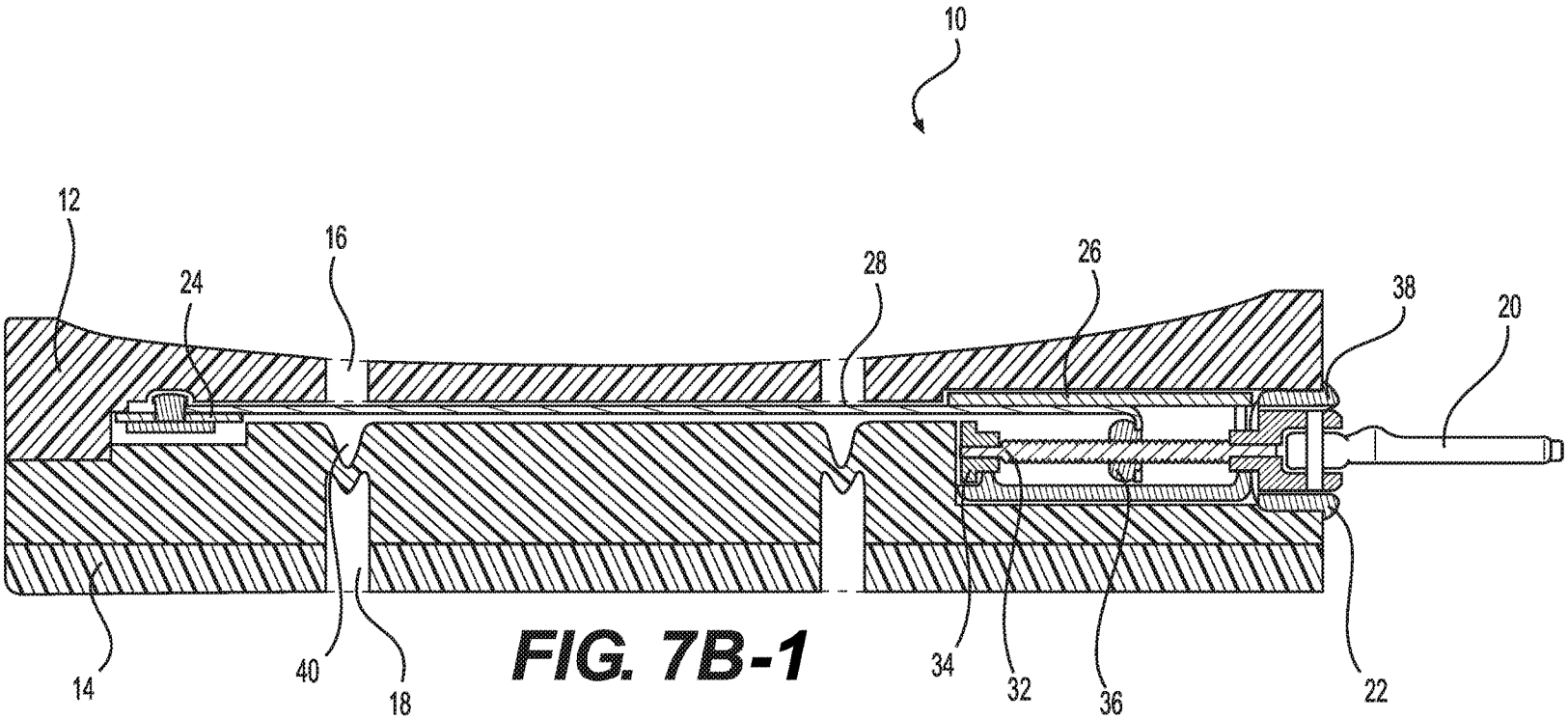
Figures 2, 7A:
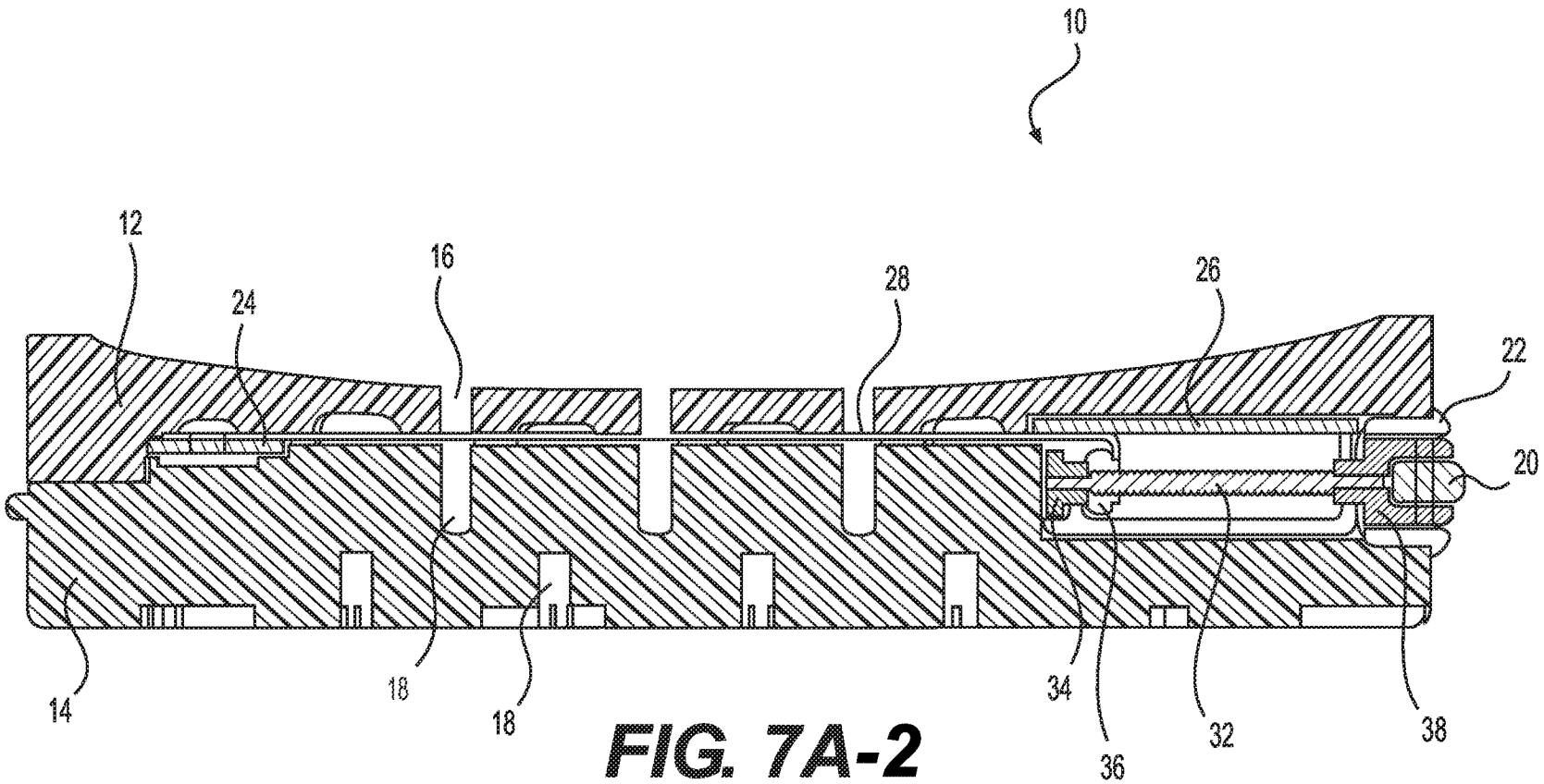
Figures 2, 7B:
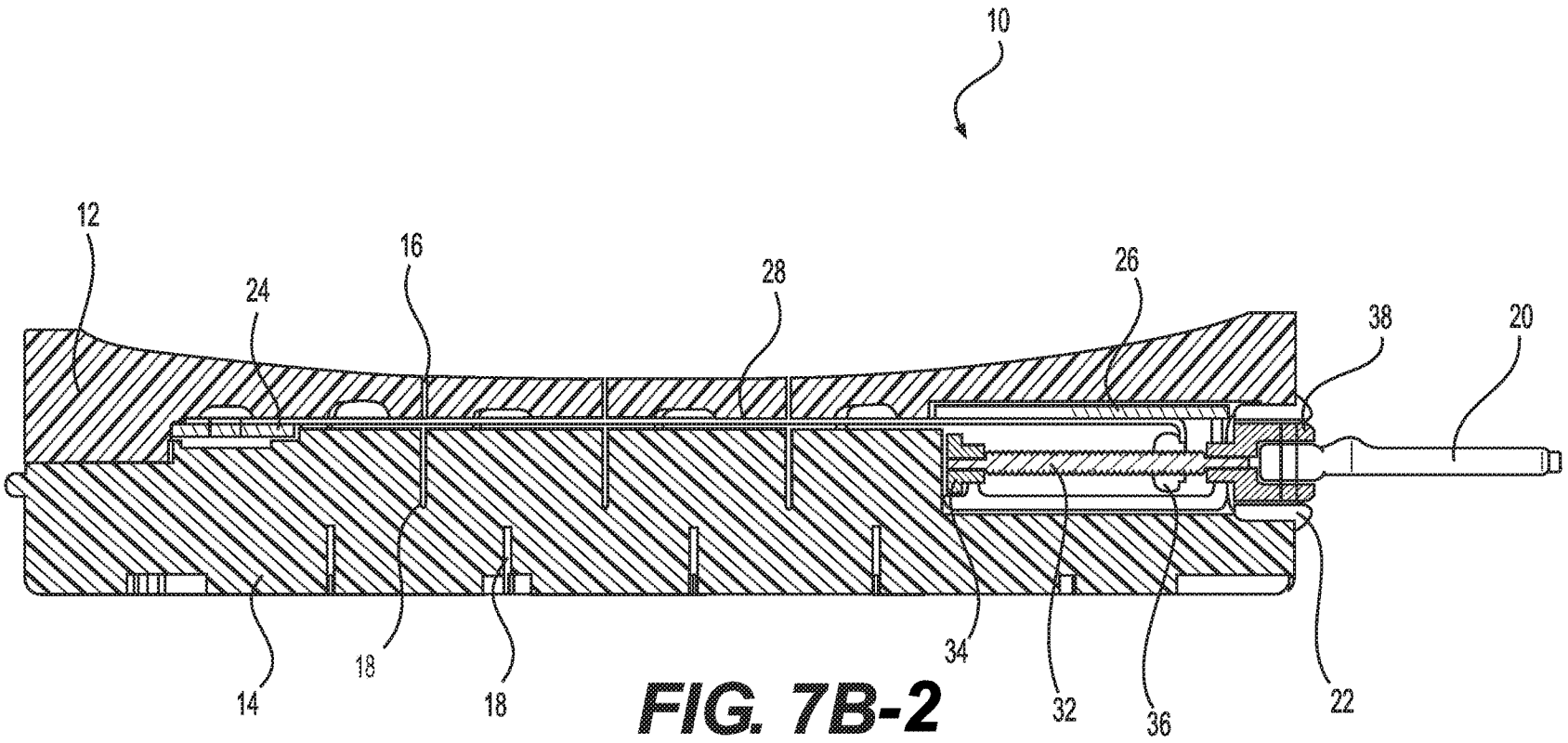

FIGS. 7B-1 and 7B-2 show a cross section of sole assembly 10 in a narrowed orientation. In this narrowed configuration, nut 36 may be in a position further from end bearing 34 than anchor 24 was in the widest orientation depicted in FIGS. 7A-1 and 7A-2. This may cause tension in actuation strap 28, and may pull anchor 24 to a position closer to adjustment device anchor 26 than in the widest orientation depicted in FIGS. 7A-1 and 7A-2. In this orientation, grooves 16 and grooves 18 may be compressed such that the overall width of sole assembly 10, and therefore the corresponding article of footwear, is reduced from the widest orientation depicted in FIGS. 7A-1 and 7A-2. In some embodiments, an actuation strap spooling mechanism may be included in lieu of or in addition to the lead screw and nut assembly.

FIGS. 7A-1 and 7A-2 also illustrate paddle 20 in a stowed position, whereas FIGS. 7B-1 and 7B-2 depict paddle 20 in a deployed position. In some embodiments, paddle 20 may be connected to lead screw 32 via paddle bearing 38. This configuration may allow paddle 20 to move from the stowed position to the deployed position without rotating lead screw 32. In FIGS. 7A-1 and 7A-2, paddle 20 is depicted in the stowed position inside paddle housing 22. In the stowed position, paddle 20 may not be capable of rotation, and therefore the width of the article of footwear is effectively fixed. This may be beneficial to the wearer, since the width of the article of footwear will not be inadvertently or unintentionally changed. Further, mere contact with an object will not cause width adjustment to occur. The stowed position of paddle 20 protects the mechanism from damage as well as the wearer from unexpected changes in fit that may cause injury.

FIGS. 7B-1 and 7B-2 show paddle 20 in a deployed position. In some embodiments, in the deployed position, paddle 20 is capable of being rotated by a wearer. Paddle 20 may protrude outward from paddle housing 22 in a direction substantially away from the instep portion of the article of footwear. This placement allows the wearer to use the hand on the same side as the article of footwear in order to adjust the width. Other placements and configurations may cause wearers to have increased difficulty reaching, and comfortably rotating paddle 20 in order to adjust the width of the article while it is being worn.

In some embodiments according to the present disclosure, the location of the components of the width adjustment assembly may be selected such that they do not coincide with the pressure points created by a wearer's foot. Particularly, the heel and ball of the foot may be areas on which the wearer bears their weight. Locating components in the sole in these areas may cause the wearer to feel discomfort. In the case of sole assembly 10, the main components of the width adjustment assembly are located in a portion of the sole that corresponds to an area between the arch and ball of a wearer's foot. This area of the forefoot region of an article of footwear will typically bear less weight, and therefore the wearer will be less likely to feel the presence of the components during use of the article.

Another design element of sole assembly 10 that may provide additional comfort is the generally flat surfaces on which upper sole 12 rests. Components such as anchor 24, adjustment device anchor 26, and actuation strap 28 may be designed to be generally flat in order to minimize the existence of corners or protrusions that may be felt by the wearer during use. The location of adjustment device housing 30 and the associated components underneath of adjustment device anchor 26 aids in the preservation of a generally flat surface for upper sole 12 to rest upon. In some embodiments, this allows for upper sole 12 to be generally flat, and to provide even support for the wearer's foot during use. Further, actuation strap 28 being flat also allows it to maintain flexibility in the shoe for added comfort. As the sole bends, particularly about the axis longitudinal to the wearers foot, the actuation strap can also bend without losing its ability to provide a strong connection between anchor 24 and adjustment device anchor 26.

The location of the adjustment device, such as paddle 20, may also be significant in the ergonomics and durability of an article of footwear in accordance with the present disclosure. The adjustment device may be of several types known in the art, such as paddles, knobs, or wheels, and may even be designed to require a tool for adjustment. In some embodiments, it may be necessary for the pitch of the lead screw to be selected such that it is substantially self-locking and does not allow axial forces on the nut to cause back-driving. The adjustment device may be positioned such as to avoid the more common contact points for an article of footwear, such as the toe area and the instep and outstep portions proximate the ball of the foot. During athletic activities, a wearer may kick or rub up against an object or surface, intentionally or unintentionally. Additionally, under some circumstances, the insteps of the left and right shoes of a wearer may come into contact with one another. By positioning an adjustment device such as paddle 20 on the outstep portion of the sole between the ball and arch of the foot, contact may be minimized. Minimizing contact can allow for increased wearable life, while decreasing instances of accidental paddle deployment or undesired mechanism adjustment.

In some embodiments according to the present disclosure, some form of indicator may be used, such as a colored indicator or a numbered indicator to allow the wearer to observe the width setting of the mechanism. Such systems may be of any type known in the art for indicating position, and may allow a wearer to obtain easily repeatable adjustments. Some embodiments may rely upon coloration or indicia on the lower sole in or around the grooves in order to allow a wearer to visually assess the width setting of the mechanism prior to or during use.

While several possible embodiments are disclosed above, embodiments of the present invention are not so limited. For instance, while several possible configurations have been disclosed, other suitable mechanism configurations and designs could be selected without departing from the spirit of embodiments of the disclosure. In addition, the location and configuration used for various features of embodiments of the present invention can be varied according to a particular article of footwear that requires a variation due to, for example, the size, necessary features, the wearer's preference, or cost considerations. Variations of a width adjustment feature according to the present disclosure may be incorporated into any desired article of footwear, including but not limited to athletic shoes, roller skates, ski bindings, and boots. Such changes are intended to be embraced within the scope of the invention.

The disclosed article including a width adjustment feature may also include other adjustable features as known in the art. Such an article is contemplated, and could potentially aid the wearer by offering additional adjustability. Additional features may be combined with the disclosed mechanism without departing from the scope of this disclosure.

The specific configurations, choice of materials, and the size and shape of various elements can be varied according to particular design specifications or constraints requiring a device, system, or method constructed according to the principles of the invention. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

The invention claimed is:

1. An article of footwear, comprising:

a sole comprising a plurality of grooves;

a width adjustment assembly comprising:

a lead screw;

an adjustment device in communication with the lead screw, and accessible to a wearer from the outside of the article of footwear;

an actuation strap in communication with the lead screw, and movable in response to rotation of the lead screw; and an anchor plate connected to the actuation strap;

wherein rotation of the adjustment device causes the lead screw to rotate, and wherein rotation of the lead screw changes the tension and/or compression in the actuation strap.

2. The article of footwear of claim 1, wherein the sole further comprises an upper sole and lower sole, and wherein the width adjustment assembly is located between the upper and lower sole portions.

3. The article of footwear of claim 1, wherein the width adjustment assembly is generally located at a position along the article of footwear that corresponds to a forefoot of the wearer.

4. The article of footwear of claim 1, wherein the width adjustment assembly further comprises an adjustment device housing.

5. The article of footwear of claim 4, wherein the adjustment device comprises an adjustment paddle having a stowed position and a deployed position, wherein the adjustment paddle is disposed in the adjustment paddle housing in the stowed position, and protrudes from the adjustment paddle housing in the deployed position.

6. The article of footwear of claim 5, wherein the adjustment paddle is capable of rotating in the deployed position, and is not capable of rotating in the stowed position.

7. The article of footwear of claim 1, wherein the anchor plate is positioned in an instep portion of the article of footwear, and the adjustment device is positioned on an outstep portion of the article of footwear.

8. The article of footwear of claim 7, wherein rotation of the lead screw in a first direction causes the actuation strap to move the anchor plate towards the outstep portion of the article of footwear and wherein rotation of the lead screw in a second direction causes the actuation strap to move the anchor plate away from the outstep portion of the article of footwear.

9. The article of footwear of claim 8, wherein movement of the anchor plate towards the outstep portion causes the one or more grooves to be compressed and wherein movement of the anchor plate away from the outstep portion causes the one or more grooves to be expanded.

10. The article of footwear of claim 1, wherein actuation strap is in communication with the lead screw via a nut, wherein the nut is attached to the actuation strap and threaded onto the lead screw.

11. An athletic shoe, comprising:

a lower sole comprising a first plurality of grooves;

an upper sole comprising a second plurality of grooves;

a width adjustment assembly comprising:

a lead screw;

an adjustment paddle in communication with the lead screw, and accessible to a wearer from the outside of the athletic shoe;

an actuation strap in communication with the lead screw, and movable in response to rotation of the lead screw; and an anchor plate connected to the actuation strap;

wherein rotation of the adjustment paddle causes the lead screw to rotate, and wherein rotation of the lead screw in a first direction increases the tension in the actuation strap and compresses the first and second plurality of grooves.

12. The athletic shoe of claim 11, wherein the width adjustment assembly is located between the upper and lower sole portions.

13. The athletic shoe of claim 11, wherein the width adjustment is generally located at a position along the athletic shoe that corresponds to a forefoot of the wearer.

14. The athletic shoe of claim 11, wherein the width adjustment assembly further comprises an adjustment paddle housing.

15. The athletic shoe of claim 14, wherein the adjustment paddle has a stowed position and a deployed position, wherein the adjustment paddle is disposed in the adjustment paddle housing in the stowed position, and protrudes from the adjustment paddle housing in the deployed position.

16. The athletic shoe of claim 15, wherein the adjustment paddle is capable of rotating in the deployed position, and is not capable of rotating in the stowed position.

17. The athletic shoe of claim 11, wherein the anchor plate is positioned in an instep portion of the athletic shoe, and the adjustment paddle is positioned on an outstep portion of the athletic shoe.

18. The athletic shoe of claim 17, wherein rotation of the lead screw in the first direction causes the actuation strap to move the anchor plate towards the outstep portion of the athletic shoe.

19. The athletic shoe of claim 11, wherein the actuation strap is in communication with the lead screw via a nut, wherein the nut is attached to the actuation strap and threaded onto the lead screw.

* * * * *